United States Patent [19]

Alderson

[11] 4,280,403

[45] Jul. 28, 1981

[54] BALE DENSITY CONTROL SYSTEM

[75] Inventor: Loren L. Alderson, Nickerson, Kans.

[73] Assignee: The Cessna Aircraft Company, Wichita, Kans.

[21] Appl. No.: 66,218

[22] Filed: Aug. 13, 1979

[51] Int. Cl.[3] ..... B30B 15/26

[52] U.S. Cl. ..... 100/43; 100/192

[58] Field of Search ..... 100/43, 192

[56] References Cited

U.S. PATENT DOCUMENTS

| | | | |
|---|---|---|---|
| 2,763,201 | 9/1956 | Hauswirth | 100/43 |
| 2,796,825 | 6/1957 | Kriegbaum et al. | 100/43 |
| 3,121,387 | 2/1964 | Fuhrwerk et al. | 100/43 |
| 4,148,254 | 4/1979 | Graber et al. | 100/43 |
| 4,166,414 | 9/1979 | Fleming et al. | 100/43 |
| 4,168,659 | 9/1979 | Yatcilla et al. | 100/43 |

*Primary Examiner*—Billy J. Wilhite

[57] ABSTRACT

Hydraulic "squeeze cylinders" control the size of the discharge orifice on an extrusion baler and are operated by a control circuit that relieves pressure in the cylinders in response to the build-up of a certain predetermined pressure level in the circuit. Pressurized fluid for the squeeze cylinders is supplied by a single-acting pump cylinder that is connected between the plunger head and its pitman rod in such a way as to deliver a charge of pressurized fluid into the circuit on each compression stroke of the plunger. A pilot-operated relief valve is operated by circuit pressure when the latter reaches a predetermined pressure level to block flow from the pump cylinder and open a relief path for fluid in the squeeze cylinders.

1 Claim, 2 Drawing Figures

BALE DENSITY CONTROL SYSTEM

BACKGROUND OF THE INVENTION

This invention relates to controlling the density of bales produced in an extrusion-type baler wherein successive charges of material are introduced into a baling chamber and are forced through a restricted orifice by a reciprocating plunger. Typical prior control systems for this class of baler have relied upon mechanical sensors which activate a separate hydraulic control circuit for squeeze cylinders that control the size of the orifice. Such sensors normally activate the circuits to either relieve or add fluid pressure depending upon the extent to which the sensors can penetrate the forming bale. In other words, the "tightness" or density of the forming bale results in the sensor being physically positioned in such a way that it performs an appropriate valving function so as to either further pressurize or depressurize the squeeze cylinders.

However, systems of this type rely upon very localized "readings" of bale density and thus may not accurately reflect the overall or average density of the bale being formed. Hence, the degree of uniformity of density throughout the bale may suffer.

Rather than sense bale density on a local, concentrated basis in the foregoing manner, the present invention contemplates sensing pressure build-up in the hydraulic circuit that controls the squeeze cylinders and takes such corrective steps as may be necessary in response to that build-up, such being possible as a way to provide the necessary control function inasmuch as the pressure build-up in the circuit is directly related to the resistance encountered by the bale as it attempts to move through the orifice under the impetus of the plunger. Thus, by basing the control system on resistance to bale movement rather than depth of penetration at any localized spot in the bale, the condition of the bale as a whole is more fully considered, to the end that adjustments which more accurately reflect the state of things can be automatically effected.

While the concept of utilizing the perception of hydraulic pressure to trigger a certain control function in a baler is not per se new, prior systems attempting to incorporate such an approach have suffered from the disadvantage of being undeuly complex and unreliable. Accordingly, one important object of the present invention is to provide a simplified system wherein a single cylinder provides the dual function of sensing the compaction force on the plunger and also acting as a pump to supply the necessary pressurized fluid to actuate the squeeze cylinders controlling the orifice.

Another important object of the present invention is to provide a fluid-pressure-triggered system as aforesaid, which is based on the principle that more nearly uniform bale density can be achieved if the system is geared toward keeping the plunger operating at a certain constant compactive force regardless of variations in crop conditions such as, for example, moisture content and the coefficient of friction between the crop and walls of the baling chamber. Inasmuch as variables of this type can and do affect the pressure level at the squeeze cylinders that is required in order to arrive at a certain constant force loading on the plunger, it is important to have a system that will accommodate such pressure fluctuations at the squeeze cylinders without causing a responsive adjustment in the system that would increase or decrease the compactive force of the plunger.

Stated differently, it is recognized that certain crop conditions may require one pressure level at the squeeze cylinders to achieve a certain amount of compactive force by the plunger while a second crop condition may require a different pressure level at the squeeze cylinders to achieve the same compactive force at the plunger. For example, straw may be easier to push through the bale chamber than hay because of straw's "slickness" and may thus require greater pressure at the squeeze cylinders in order to achieve the same compactive force from the plunger as with hay. Accordingly, if the system is to be based upon the proposition that more uniformity of bale density can be ultimately achieved if the system is geared to maintaining a certain constant compactive force of the plunger, then it is desirable to have a system that will achieve such end notwithstanding the fact that it may take different squeeze pressures at different times to produce that certain compactive force from the plunger.

Hence, it is an important object of this invention to provide a fluid-pressure-triggered system which is capable of operating at a relatively constant compactive plunger force while tolerating wide fluctuations in pressure levels at the squeeze cylinders.

An additional important object of this invention is to mechanically link the plunger with the hydraulic pump of the system in such a way that the resistance encountered by the plunger during its compaction stroke is transmitted to the pump so as to displace the latter through a pumping stroke, thus adding a charge of pressurized fluid to the hydraulic circuit that can be routed to the squeeze cylinders if additional pressure is required at that location to bring the compactive force of the plunger up to its desired level.

Additionally, an important object of this invention is to provide an arrangement wherein increases or reductions in the pressure level of the squeeze cylinders are made in relatively small increments so as to avoid the possibility of sudden drastic pressure drops or increases that would adversely affect bale density.

Yet another important object of this invention is to provide a way in which the compactive force for the plunger can be selected or adjusted as may be necessary and desirable.

A further object of this invention is to void the requirement for an independent pump source for actuating the squeeze cylinders.

The invention will be more readily understood when the following description of certain embodiments are described in detail in conjunction with the drawing illustrating the invention in schematic form.

In the drawings:

FIG. 1 is a largely schematic view of the density control system with the control valve shown in detailed section; and FIG. 2 is a modified form of the control valve of FIG. 1.

DETAILED DESCRIPTION OF THE PREFERRED EMBODIMENT

Figure 1:
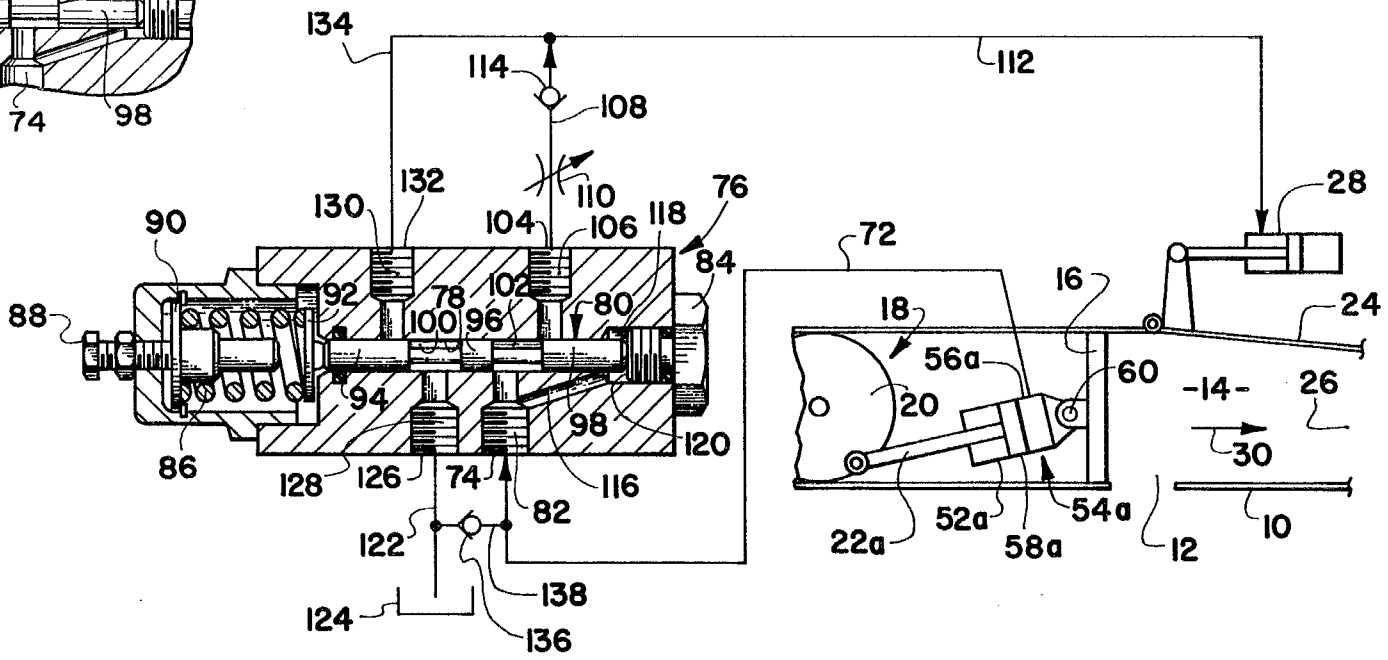

FIG. 1 is a largely schematic view of a density control system according to the principles of the present invention. The bale case 10 has a lateral opening 12 through which the material to be baled is introduced into the baling chamber 14. A plunger 16 is reciprocated within the chamber 14 by apparatus 18 which takes the form of a rotating drive wheel or crankshaft 20 connected to a pitman rod 22a. Laterally shiftable structure which may take the form of a wall 24 of the bale case 10 cooperates with the remainder of the bale case to define a discharge orifice 26 whose dimensions may be restricted relative to the ramainder of the bale case 10 through one or more devices in the nature of squeeze cylinders 28 coupled mechanically with the shiftable wall 24. Thus the reciprocating plunger 16 packs material through the bale case 10 in the direction of the arrow 30 and against the resistance afforded by the restricted nature of orifice 26. The pitman rod 22a is connected to a single-acting hydraulic cylinder 54a with the pitman rod 22a connected to cylinder piston 58a. There is a lost motion connection between the crankshaft 20 and plunger 16 with the movement of cylinder piston 58a either towards chamber 56a or chamber 52a. Hydraulic cylinder 54a could also be positioned in other places such as directly on crankshaft 20 which would likewise sense the load exerted by the plunger. The geometry and size of cylinders 28 and 54a is such that the minimum compacting cylinder pressure is always greater than the pressure required to move the squeeze cylinder. This is necessary if cylinder 54a is to function as a pump.

Located between hydraulic cylinder 54a and squeeze cylinder 28 is a pilot-operated valve 76 which regulates flow to and from squeeze cylinder 28. Cylinder chamber 56a is connected to high pressure port 74 in valve 76 via line 72. Port 74 communicates with valve bore 78 and pilot chamber 118 via lateral passage 116. Slidably positioned in valve bore 78 is valve spool 80 which includes valve lands 94, 96 and 98 separated by valve spool grooves 100 and 102. The right end of valve spool 80 is subject to pilot pressure in chamber 118 while the left end of valve spool 80 is biased rightwardly by spring 86. The biasing force on spring 86 is adjustable through washer 90 and setscrew 88 so as to vary the pressure-compensating level at which the valve 76 functions. Valve spool 80's most rightwardly position is determined by the positioning of plug 84. High pressure port 74 intersects valve bore 78 via passage 82 and lateral pilot passage 116. Valve bore 78 is also intersected by passage 106 which terminates in outlet port 104. Dump line 122 of the circuit connects reservoir 124 with drain port 126 which in turn intersects the valve spool bore 78 via passage 128. Also intersecting bore 78 is passage 130 which terminates in inlet port 132 which is in turn connected to the squeeze cylinder 28 via lines 134 and 112. Outlet port 104 is also connected to squeeze cylinder 28 via line 108 and 112 crossing check valve 114 and orifice 110. The makeup fluid for cylinder or pump 54a passes through line 138 from reservoir 124 across check valve 136 into line 72. This makeup flow is drawn across line 138 during the return stroke of the plunger.

OPERATION

Below a certain preset pressure level, valve spool 80 of pilot-operated valve 76 remains in its right-most position, as illustrated in the drawing. In this position, spool land 98 allows flow from motor 54 to squeeze cylinder 28. Also in this position, valve spool land 94 blocks drain flow from squeeze cylinder 28 to reservoir 124 via passage 130, spool groove 100, and passage 128. With crankshaft 20 rotating and pitman rod 22a reciprocating back and forth, plunger 16 begins to compact material which has entered opening 12. As resistance begins to build on plunger 16 due to the reduction of orifice 26, the pressure increases within cylinder 54a. Thus as plunger 16 moves through its compaction stroke, in the direction of arrow 30, a charge of oil is forced from pump 54a along its operating path into squeeze cylinder 28 with the pressure level of the oil increasing as the force on the plunger increases. There is a small amount of lost motion between pitman rod 22a and plunger 16 because of the retraction of cylinder piston 58a in cylinder 54a. When pitman rod 22a completes it compaction stroke, it reverses direction on its return stroke and moves to the left extending the cylinder piston 58a, as seen in the drawing. This causes the pump 54a to be drawn through a suction stroke by the force exerted by rod 22a. The effect of this suction stroke causes check valve 136 to unseat, allowing a charge of fluid to be drawn from reservoir 124 through line 138 into a pump chamber 56a. Check valve 114 in line 108 prevents the pump 54a from drawing any fluid from squeeze cylinder 28. As a result of this pumping action on the part of pump 54a, the operating path from pump 54a to squeeze cylinder 28 is intermittently progressively pressurized since the squeeze cylinder 28 is shifting wall 24 in a clockwise direction so as to further squeeze down the material being compacted by plunger 16. As the squeeze cylinder reduces the orifice diameter, the resistance of the bale to advancement by plunger 16 increases and the compactive force on the latter after each fresh charge of material also increases.

When a certain pressure level is reached during the compaction stroke of the plunger, the pressure is felt on the end 120 of valve spool 80 causing spool 80 to shift leftwardly against the force of spring 86. This causes spool land 98 to close off the flow to squeeze cylinder 28. If the compaction force continues to rise, the pressure in pilot chamber 118 will cause valve spool 80 to shift further to the left with spool land 94 opening to squeeze cylinder 28 to drain via lines 112, 134 and 122. This causes the squeeze cylinder 28 to gradually open discharge orifice 26. This in turn decreases the resistance to plunger 16 causing the pressure in pump chamber 56a and pilot chamber 118 to drop, thereby allowing the valve spool 80 to shift to the right, first closing dump line 122 an then land 98 opening a flow path to squeeze cylinder 28 on its next compaction stroke.

Figure 2:
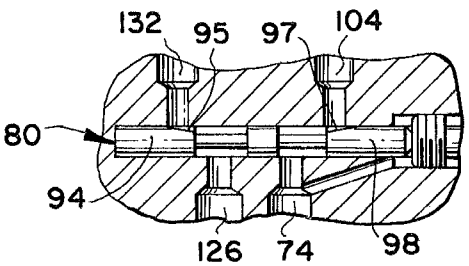

To sense the load over the full stroke of plunger 16, orifice 110 is necessary, otherwise piston 58a might reach the end of its cylinder before the end of the compaction stroke. If piston 58a bottoms out, cylinder 54a will no longer function as a pressure sensor and valve 76 cannot relieve the circuit, which leads to overloading the system. The restricting of flow to squeeze cylinder 28 can also be achieved by some form of notching 97 on spool land 98, as shown in FIG. 2. A restriction of return flow from the squeeze cylinder 28 is also desired so that the orifice 26 opens in small increments. This restriction can be achieved by notch 95 in land 94, as shown in FIG. 2, or smaller sizing of lines 134 and 112. For cylinder 54a to properly function, piston 58a must always be floating so as to perform its pressure sensing function.

Having described the invention with sufficient clarity to enable those familiar with the art to construct and use it, I claim:

1. A bale density control system on a conventional reciprocating plunger-type baler with a squeeze cylinder to control the size of the discharge orifice, the baler being driven by a pitman rod and crankshaft, the system adjusts the squeeze cylinder of the baler to maintain bale density regardless of changing conditions in the material being baled, the improvement comprising:

a linear hydraulic cylinder means positioned between the crankshaft and the plunger with the piston rod of the cylinder means comprising an extension of and being the pitman rod and the cylinder means being hydraulically connected to the squeeze cylinder, said cylinder means being attached so that any load on the pitman rod is transmitted to the cylinder means causing the cylinder means to pump oil to the squeeze cylinder during the entire compaction stroke of the plunger thereby effecting a lost motion between the crankshaft and plunger;

a fluid supply means connected to said cylinder means for replenishing fluid in the cylinder means during the return stroke of the plunger and a check valve positioned between the supply and cylinder means to prevent flow to the supply means; and a pilot operated valve means located between the cylinder means and squeeze cylinder which passes flow from the cylinder means to the squeeze cylinder at pressures below a prearranged level while blocking flow from the cylinder means to the squeeze cylinder at said prearranged level and dumping fluid in the squeeze cylinder to drain when the pressure in the linear cylinder means exceeds said prearranged level.

* * * * *